US008286645B2

(12) United States Patent
Kyu et al.

(10) Patent No.: US 8,286,645 B2
(45) Date of Patent: Oct. 16, 2012

(54) HAIR IRON

(75) Inventors: Cho Byung Kyu, Incheon (KR); Oh Wha Joong, Incheon (KR)

(73) Assignee: Lisa Parberry, Bellingham, WA (US)

( * ) Notice: Subject to any disclaimer, the term of this patent is extended or adjusted under 35 U.S.C. 154(b) by 14 days.

(21) Appl. No.: 12/625,763

(22) Filed: Nov. 25, 2009

(65) Prior Publication Data

US 2010/0132733 A1 Jun. 3, 2010

Related U.S. Application Data

(60) Provisional application No. 61/118,292, filed on Nov. 26, 2008.

(51) Int. Cl.

| | |
|---|---|
| ***A45D 1/00*** | (2006.01) |
| ***A45D 2/40*** | (2006.01) |
| ***A45D 2/00*** | (2006.01) |
| ***A45D 1/04*** | (2006.01) |
| ***A45D 24/10*** | (2006.01) |

(52) U.S. Cl. ..... 132/224; 132/223; 132/269; 132/118; 219/225

(58) Field of Classification Search ..... 132/224, 132/212, 118, 223, 203, 206, 207, 210, 211, 132/226, 227, 229, 230, 231–238, 244, 269, 132/271, 119.1, 120; 219/222, 223, 225, 219/227, 228, 229, 245; 34/96, 283, 97, 34/266; 392/374, 379, 380

See application file for complete search history.

(56) References Cited

U.S. PATENT DOCUMENTS

| | | | | | |
|---|---|---|---|---|---|
| 1,731,522 | A * | 10/1929 | Signe | 132/224 |
| 2,096,312 | A * | 10/1937 | Thomsen | 132/231 |
| 2,130,748 | A * | 9/1938 | Suter | 132/211 |
| 2,880,299 | A * | 3/1959 | Jones | 132/232 |
| 3,610,258 | A * | 10/1971 | Van Droogenbroeck | 132/269 |
| 4,243,061 | A * | 1/1981 | Buchanan | 132/118 |
| 4,382,174 | A * | 5/1983 | Barns | 392/410 |
| 4,602,143 | A * | 7/1986 | Mack et al. | 219/225 |
| 4,740,669 | A * | 4/1988 | Takimae | 219/225 |
| 4,910,382 | A * | 3/1990 | Kakuya et al. | 219/222 |
| 5,294,777 | A * | 3/1994 | Denhup | 219/225 |
| 5,522,407 | A * | 6/1996 | Kelsey | 132/231 |
| 5,769,100 | A * | 6/1998 | Alexander | 132/271 |
| 6,223,753 | B1 * | 5/2001 | Lo | 132/224 |
| 6,554,000 | B2 * | 4/2003 | Lin | 132/232 |
| 7,178,532 | B2 * | 2/2007 | Kayser | 132/224 |
| 7,800,020 | B2 * | 9/2010 | Ceva | 219/222 |
| 2004/0124188 | A1 * | 7/2004 | Altamore | 219/225 |
| 2006/0108344 | A1 * | 5/2006 | Kim et al. | 219/225 |
| 2007/0251539 | A1 * | 11/2007 | Tackett et al. | 132/224 |
| 2008/0053982 | A1 * | 3/2008 | Ceva | 219/225 |

(Continued)

*Primary Examiner* — Vanitha Elgart

(74) *Attorney, Agent, or Firm* — Michael Best & Friedrich LLP

(57) ABSTRACT

Disclosed is a hair iron having a modified heating plate. A surface of the heating plate making contact with hair is inclined by a predetermined angle relative to a horizontal plane of a handle, and a far-infrared ray device is installed on the surface of the heating plate. The hair iron includes an upper body and a lower body coupled with the upper body by a hinge section. Each of the upper and lower bodies includes a handle formed at one end thereof with the hinge section, a supporter extending from the handle, and a heating plate attached to the supporter and provided with a far-infrared ray device that emits far-infrared rays. A horizontal plane of the heating plate is inclined relative to a horizontal plane of the handle by a predetermined angle.

10 Claims, 5 Drawing Sheets

U.S. PATENT DOCUMENTS

2008/0216860 A1* 9/2008 Legrain ..... 132/224
2009/0159093 A1* 6/2009 Yu ..... 132/211
2009/0260650 A1* 10/2009 Jung ..... 132/224
2010/0031970 A1* 2/2010 Klovstad ..... 132/211
2010/0078038 A1* 4/2010 Shami et al. ..... 132/224
2010/0089413 A1* 4/2010 Wright et al. ..... 132/211
2010/0132732 A1* 6/2010 Park ..... 132/224
2010/0212683 A1* 8/2010 Mizuno ..... 132/223
2010/0242985 A1* 9/2010 Kaizuka ..... 132/224
2011/0000501 A1* 1/2011 Kaizuka ..... 132/232
2011/0017225 A1* 1/2011 Devulapalli ..... 132/118
2011/0108052 A1* 5/2011 Morgandi et al. ..... 132/230
2011/0120491 A1* 5/2011 You ..... 132/223

* cited by examiner

Figure 1
PRIOR ART
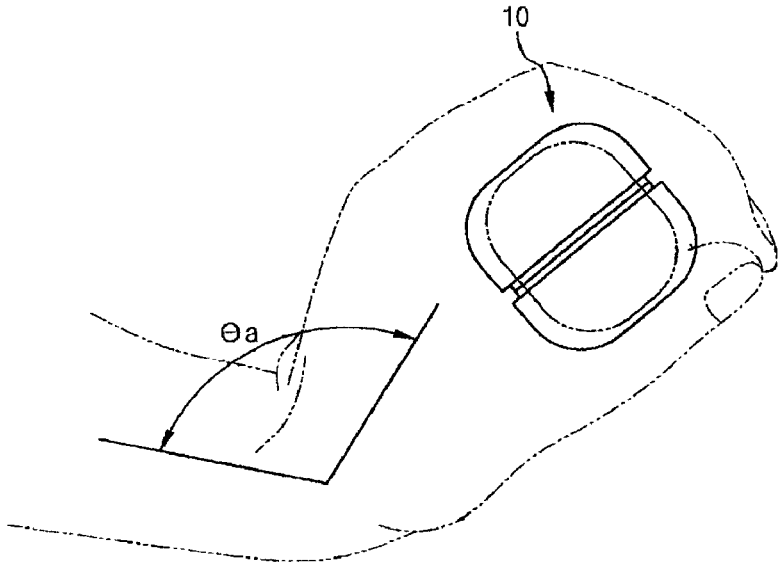
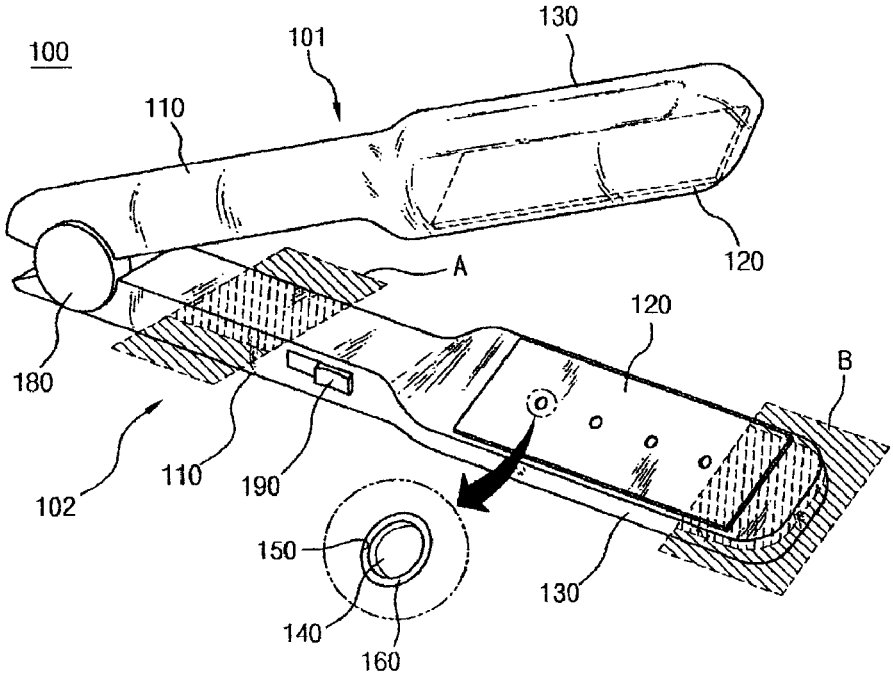
Figure 2

HAIR IRON

CROSS-REFERENCE TO RELATED APPLICATIONS

This application claims priority to U.S. Provisional Patent Application No. 61/118,292 filed on Nov. 26, 2008, the entire contents of which are incorporated herein by reference.

BACKGROUND OF THE INVENTION

1. Field of the Invention

The present invention relates to a hair iron. More particularly, the present invention relates to a hair iron having a modified heating plate.

2. Description of the Related Art

In general, a hair iron includes an upper body and a lower body which are coupled to each other by a hinge section. Heaters are installed in the upper and lower bodies and heating plates are provided in the vicinity of the heaters.

The hair iron having the above structure usually maintains an open state due to an elastic member, such as a spring, installed in the hinge section, so a user must press handle sections of the upper and lower bodies using a hand in use. That is, the user operates the heaters installed in the upper and lower bodies to heat the heating plates, and then manipulates the heating plates after putting the hair between the heating plates to obtain a desired hair style.

Such a hair iron is used to change straight hair to curly hair, or vice versa. In addition, the user can make a desired hair style within a short period of time using the hair iron. Thus, the hair iron is extensively used in hair shops as well as in the home.

One of the hair designs obtainable by using a hair iron is a curly hair design. In curly hair designs, hair is dressed in a straight manner, and then a tip portion of the straight hair is curled inward.

However, in order to form curly hair, a user or a hair designer must twist a wrist at the tip portion of the hair while pulling the hair in a straight direction using the hair iron. For this reason, damage may be caused to the wrist of the user or the hair designer when forming curly hair using the hair iron. If an ordinary person performs hairdressing using a hair iron to form curly hair, damage applied to the muscle of the wrist or shoulder may not be severe. However, in the case of hair designers who perform curly hairdressing several times in a day, severe damage may be caused to the muscle of the wrist or shoulder.

FIG. 1 is a view illustrating a conventional hair iron in use. As shown in FIG. 1, if a hair designer pulls the hair iron 10 toward a body of the hair designer in a state in which hair of a customer is put in the hair iron 10, the wrist of the hair designer is bent by a predetermined angle θa, so that damage may be caused to the wrist as well as the shoulder of the hair designer. In order to avoid such damage, the hair designer performs curly hairdressing while directing the hair iron in a downward direction as much as possible. However, in this case, the hair designer must bend his or her body during curly hairdressing, causing other damage (such as lumbago).

Meanwhile, in order to obtain curly hair, the user or the hair designer must put hair in the hair iron and then inwardly bend the tip portion of the hair by using an edge of the heating plate. However, the edge of the heating plate employed in the conventional hair iron has an angular configuration, so that damage may be caused to the hair.

Recently, customer demand for healthy hair has increased, so a dryer using a far-infrared rays has been proposed. However, a hair iron using far-infrared rays has not been proposed. The hair directly makes contact with the heating plate in the hair iron, so the far-infrared rays must be emitted from the heating plate. However, since the heating plate generates high-temperature heat, it is difficult to install a far-infrared ray device in the heating plate.

The present invention has been made to solve the above problems occurring in the prior art, and an object of the present invention is to provide a hair iron in which a surface of a heating plate making contact with hair is inclined by a predetermined angle relative to a horizontal plane of a handle, and a far-infrared ray device is installed on the surface of the heating plate.

In order to accomplish the above object, according to the present invention, there is provided a hair iron including an upper body and a lower body coupled with the upper body by a hinge section. Each of the upper and lower bodies includes a handle formed at one end thereof with the hinge section, a supporter extending from the handle, and a heating plate attached to the supporter and provided with a far-infrared ray device that emits far-infrared rays. A horizontal plane of the heating plate is inclined relative to a horizontal plane of the handle by a predetermined angle.

According to the present invention, the surface of the heating plate making contact with the hair is inclined by a predetermined angle relative to the horizontal plane of the handle, so that users can easily perform hairdressing without excessively bending the wrist or shoulder. Thus, damage caused to the muscle or bone of users can be attenuated.

In addition, according to the present invention, the edge of the heating plate is rounded, so that hair can be prevented from being damaged by the edge of the heating plate.

Further, since the far-infrared ray device is installed on the surface of the heating plate, users can obtain healthy hair.

BRIEF DESCRIPTION OF THE DRAWINGS

The above and other advantages of the present invention will become readily apparent with reference to the following detailed description when considered in conjunction with the accompanying drawings wherein:

FIG. 1 is a view illustrating a conventional hair iron in use;

FIG. 2 is a perspective view illustrating a hair iron according to a first embodiment of the present invention;

DESCRIPTION OF THE EMBODIMENTS

Hereinafter, a hair iron according to exemplary embodiments of the present invention will be explained in detail with reference to the accompanying drawings.

Figure 3:
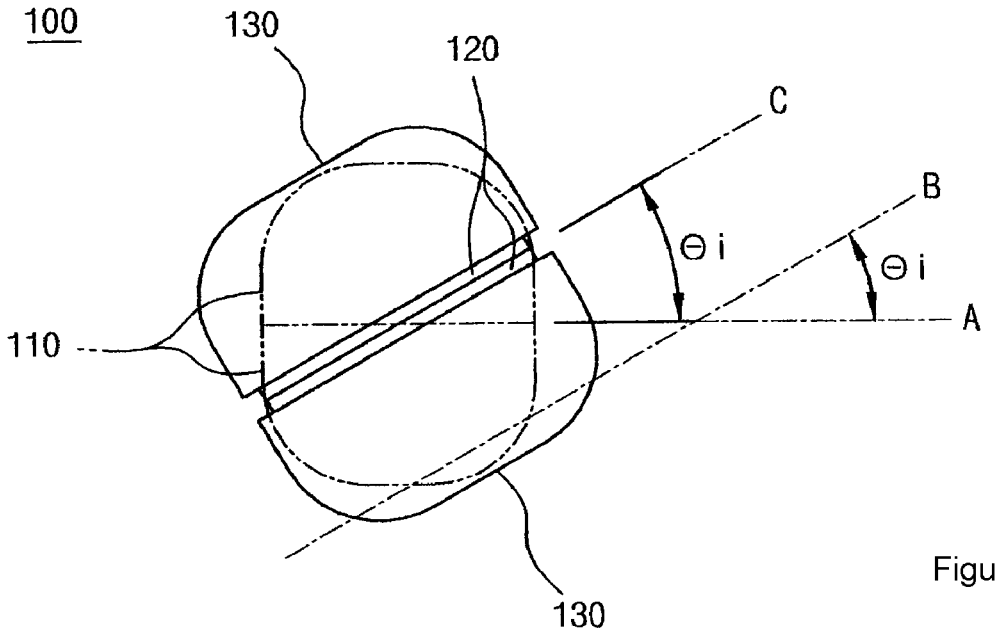
FIG. 3 is a side view illustrating an inclination angle of a surface of a heating plate provided in the hair iron shown in FIG. 2.

FIG. 2 is a perspective view illustrating a hair iron according to a first embodiment of the present invention, and FIG. 3 is a side view illustrating an inclination angle of a surface of a heating plate provided in the hair iron shown in FIG. 2.

As shown in FIG. 2, the hair iron 100 according to the first embodiment of the present invention includes an upper body 101 and a lower body 102, which are coupled with each other by a hinge section 180. The hinge section defines an axis of rotation (not shown). The upper body 101 and the lower body 102 of the hair iron 100 are movable about the axis.

The upper and lower bodies 101 and 102 include handles 110 rotatably coupled to the hinge section 180 and supporters 130 extending from the handles 110. Heating plates 120 are attached to the supporters 130 while facing each other. Heaters (not shown) connected to the heating plates 120 are accommodated in the supporters 130. That is, the heating plates 130 make contact with each other when the upper and lower bodies 110 and 120 rotate about the hinge section 180.

Referring to FIG. 2, at least two holes 150 are formed in each heating plate 130 lengthwise along the heating plate 130. A far-infrared ray device 140 is provided in each hole to emit far-infrared rays. The far-infrared ray device 140 will be described later with reference to FIG. 8.

An on/off switch 190 is provided at one side of the lower body 102. The on/off switch 190 provides current to the heater installed in the heating plate 120 or shuts off the current supplied to the heater.

Meanwhile, as shown in FIGS. 2 and 3, in the hair iron 100 according to the first embodiment of the present invention, the surface of the heating plate 120 attached to the upper and lower bodies 101 and 102 is inclined by a predetermined angle θi relative to a horizontal plane of the handle. The term "horizontal plane" of the handle refers to a horizontal section of the handle parallel to the ground, such as a first horizontal plane A shown in FIG. 2.

If the surface of the heating plate 120 is inclined by the predetermined angle θi relative to the horizontal plane of the handle, the hair designer can perform curly hairdressing without excessively bending the wrist of the hair designer.

The hair iron 100 according to the present invention has been suggested to solve the problems of the conventional hair iron shown in FIG. 1, in which the heating plates are attached horizontally to the surface of the handle so that the hair designer must bend the wrist to perform curly hairdressing.

That is, in some embodiments of the present invention, the bending angle θa and the bending direction of the wrist are taken into consideration when the user or the hair designer performs curly hairdressing using the hair iron. In other words, since the surface of the heating plate is inclined by the predetermined angle θi relative to the horizontal plane of the handle, the user or the hair designer can perform curly hairdressing using the hair iron without excessively bending the wrist. To this end, a horizontal plane B of the supporter 130, to which the heating plate 120 of the upper and lower bodies is attached, is inclined relative to the horizontal plane of the handle by the predetermined angle θi. The term "horizontal plane" of the supporter refers to a horizontal section of the supporter parallel to a surface of a housing forming the outer appearance of the supporter, such as a second horizontal plane B shown in FIG. 2. That is, according to the second embodiment of the present invention, the horizontal plane B of the supporter is parallel to the surface C of the heating plate, so the inclination angle θi between the horizontal plane B of the supporter and the horizontal plane A of the handle is identical to the inclination angle θi between the surface C of the heating plate and the horizontal plane A of the handle.

Figure 4:
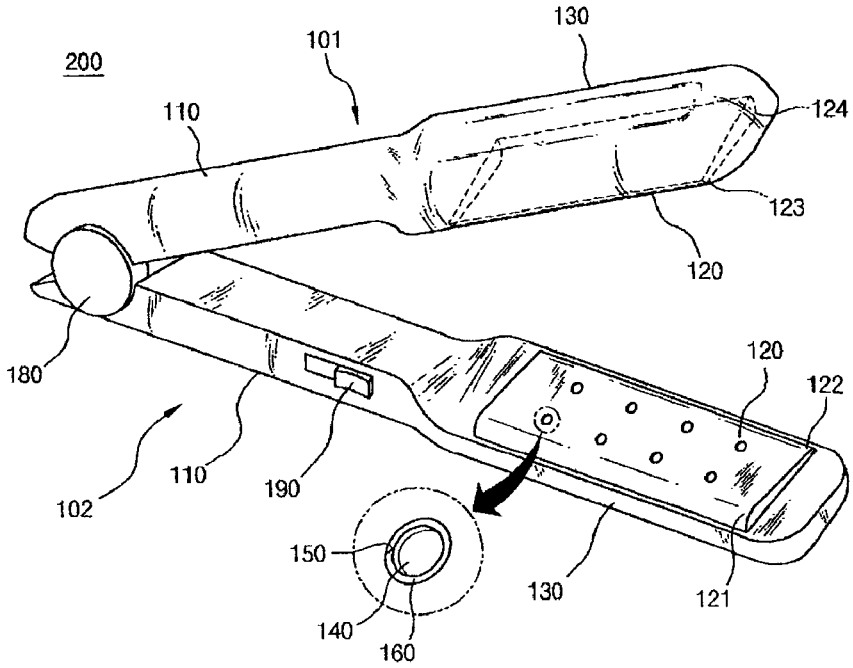
FIG. 4 is a perspective view illustrating a hair iron according to a second embodiment of the present invention.
Figure 5:
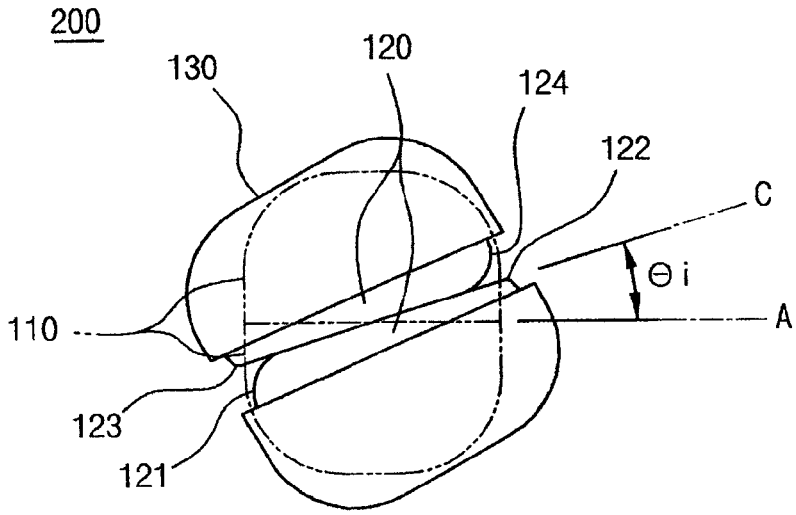
FIG. 5 is a side view illustrating an inclination angle of a surface of a heating plate provided in the hair iron shown in FIG. 4.

FIG. 4 is a perspective view illustrating a hair iron according to a second embodiment of the present invention, and FIG. 5 is a side view illustrating an inclination angle of a surface of a heating plate provided in the hair iron shown in FIG. 4. In the following description, the same reference numerals will be assigned to the elements identical to those of the first embodiment shown in FIGS. 2 and 3, and detailed description thereof will be omitted or simplified in order to avoid redundancy.

As shown in FIGS. 4 and 5, the hair iron according to the second embodiment of the present invention is substantially identical to the hair iron according to the first embodiment of the present invention except that the edge of the heating plate is rounded.

That is, the hair iron 200 according to the second embodiment of the present invention has a structure substantially identical to the structure of the hair iron according to the first embodiment of the present invention. However, the hair iron 200 according to the second embodiment of the present invention is characterized in that the edge of the heating plate 120 is rounded to prevent hair from being damaged by the edge of the heating plate 120.

According to the second embodiment of the present invention, both edges of the heating plate can be rounded. However, in this case, the thickness of the heating plate may increase, so that the whole volume of the hair iron is also increased. Thus, preferably, one edge of the heating plate is rounded.

Meanwhile, as described above, if only one edge of the heating plate is rounded, the structure of the heating plate formed in the upper and lower bodies 101 and 102 is symmetrically formed as shown in FIG. 5. That is, two heating plates are preferably aligned in such a manner that a rounded edge 121 of the heating plate of the lower body makes contact with an angular edge 123 of the heating plate of the upper body, and an angular edge 122 of the heating plate of the lower body makes contact with a rounded edge 124 of the heating plate of the upper body.

In addition, the inclination angle θi described in the hair iron according to the first embodiment of the present invention can be identically applied to the hair iron according to the second embodiment of the present invention. That is, in the hair iron according to the second embodiment of the present invention, the surface C of the heating plate is inclined relative to the horizontal plane A of the handle by the inclination angle θi. More specifically, according to the first embodiment of the present invention, the inclination angle θi between the horizontal plane B of the supporter and the horizontal plane A of the handle is identical to the inclination angle θi between the surface C of the heating plate and the horizontal plane A of the handle. However, according to the second embodiment of the present invention, the surface C of the heating plate may not coincide with the horizontal plane B of the supporter, and the surface C of the heating plate is inclined relative to the horizontal plane A of the handle by the inclination angle θi.

In addition, the holes 150 and the far-infrared ray device 140 according to the first embodiment of the present invention can be identically applied to the surface of the heating plate of the hair iron according to the second embodiment of the present invention. Referring to FIG. 4, at least two holes 150 are aligned lengthwise along the heating plate in two rows. The far-infrared ray device 140 will be described later with reference to FIG. 8.

Figure 6:
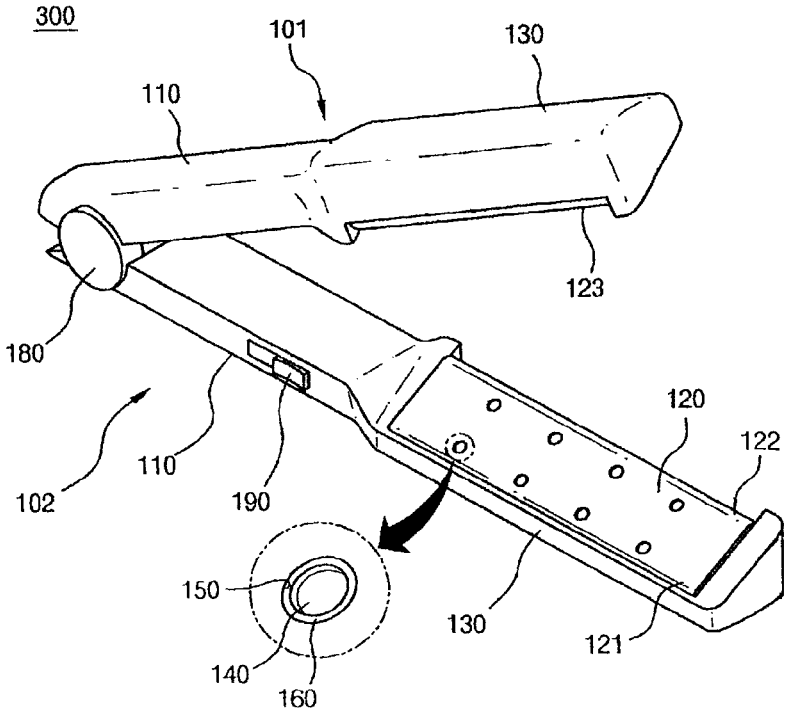
FIG. 6 is a perspective view illustrating a hair iron according to a third embodiment of the present invention.
Figure 7:
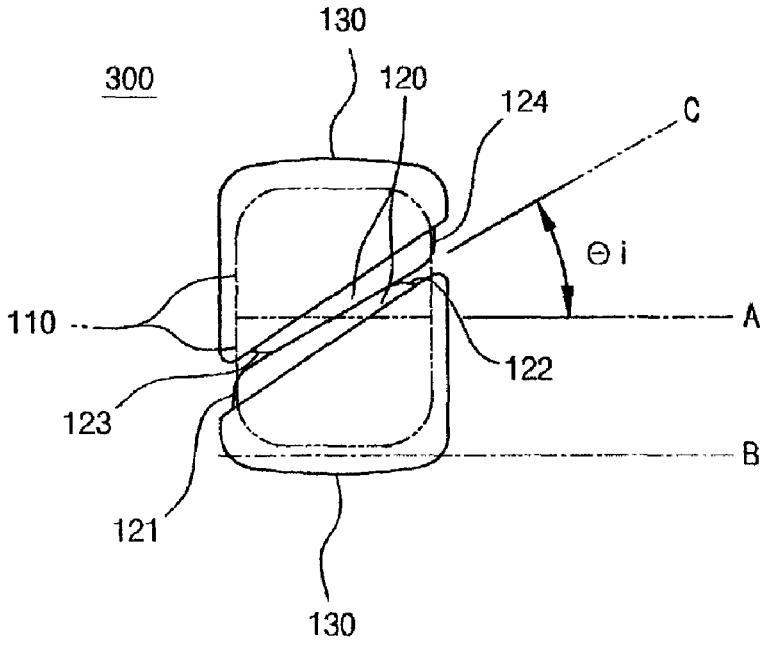
FIG. 7 is a side view illustrating an inclination angle of a surface of a heating plate provided in the hair iron shown in FIG. 6.

FIG. 6 is a perspective view illustrating a hair iron according to a third embodiment of the present invention, and FIG. 7 is a side view illustrating an inclination angle of a surface of a heating plate provided in the hair iron shown in FIG. 6. In the following description, the same reference numerals will be assigned to the elements identical to those of the first and second embodiments shown in FIGS. 2-5, and detailed description thereof will be omitted or simplified in order to avoid redundancy.

As shown in FIG. 6, the hair iron 300 according to the third embodiment of the present invention includes an upper body 101 and a lower body 102, which are coupled with each other by a hinge section 180. The upper and lower bodies 101 and 102 include handles 110 rotatably coupled to the hinge section 180 and supporters 130 extending from the handles 110. Heating plates 120 are attached to the supporters 130 while facing each other.

The hair iron according to the third embodiment of the present invention is similar to the hair iron according to the first embodiment of the present invention in that the heating plate 120 is inclined relative to the horizontal plane of the handle by the inclination angle θi. In addition, the hair iron according to the third embodiment of the present invention is different from the hair iron according to the first embodiment of the present invention in that the horizontal plane of the supporter 130 supporting the heating plate 120 is parallel to the horizontal plane of the handle 110.

That is, according to the first embodiment of the present invention, the horizontal plane of the supporter 130 is inclined relative to the horizontal plane of the handle by the inclination angle θi, so that the surface of the heating plate, which is supported by the supporter, is inclined relative to the horizontal plane of the handle by the inclination angle θi. However, according to the third embodiment of the present invention, although the horizontal plane B of the supporter is parallel to the horizontal plane A of the handle, the surface C of the heating plate is supported by the supporter such that the surface C of the heating plate is inclined relative to the horizontal plane of the handle by the inclination angle θi. However, the present invention is not limited thereto.

According to the third embodiment of the present invention, since a mounting section (not shown) of the supporter onto which the heating plate is attached is inclined relative to the horizontal plane of the handle, the surface C of the handle can be inclined relative to the horizontal plane A of the handle by the inclination angle θi.

Meanwhile, the heating plate employed in the first embodiment of the present invention can be used in the third embodiment of the present invention. In addition, the heating plate employed in the second embodiment of the present invention can be used in the third embodiment of the present invention as shown in FIGS. 6 and 7.

That is, according to the third embodiment of the present invention, the heating plate of the upper body has one rounded edge 124 and the heating plate of the lower body has one rounded edge 121. In addition, the surface C of the heating plate is inclined relative to the horizontal plane A of the handle by the inclination angle θi.

The holes 150 and the far-infrared ray device 140 according to the first or second embodiments of the present invention can be formed on the surface of the heating plate employed in the hair iron according to the third embodiment of the present invention. Referring to FIG. 6, the holes 150 and the far-infrared ray device 140 identical to those of the second embodiment of the present invention are formed on the heating plate of the hair iron according to the third embodiment.

Figure 8:
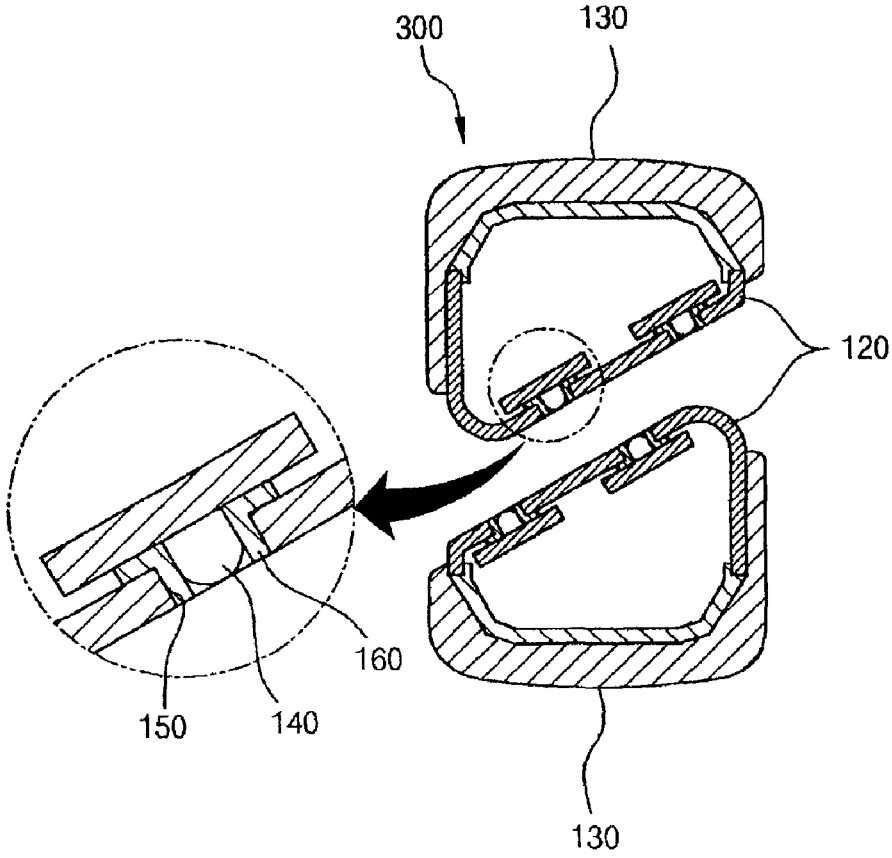
FIG. 8 is a sectional view of a lower body of a hair iron according to an embodiment of the present invention.

FIG. 8 is a sectional view of the lower body of the hair iron according to the present invention, in particular, the lower body of the hair iron shown in FIG. 6.

As shown in FIG. 8, the holes 150 and the far-infrared ray device 140 are formed in the heating plate 120 of the hair iron according to the present invention. The far-infrared ray device 140 emits far-infrared rays. For instance, the far-infrared ray device 140 may include LEDs that emit far-infrared rays. Various devices, which are generally known in the art, can be employed as the far-infrared ray device, so the detailed description thereof will be omitted.

In order to prevent the far-infrared ray device from being damaged by high-temperature heat emitted from the heating plate, as shown in FIG. 8, an insulating member 160 is interposed between the hole 150 of the heating plate 120 and the far-infrared ray device 140.

Figure 9:
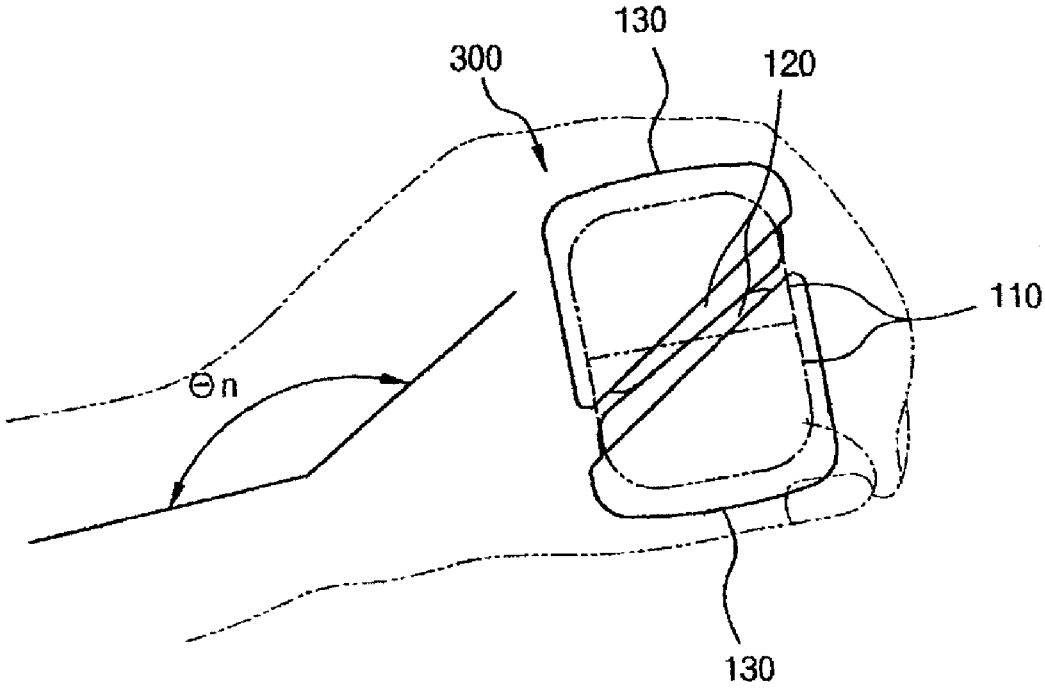
FIG. 9 is a view showing a hair iron according to the present invention in use.

FIG. 9 is a view showing the hair iron according to the present invention in use. As shown in FIG. 9, the wrist of the user using the hair iron according to the present invention is less bent than the wrist of the user using the conventional hair iron. That is, the bending angle θa of the wrist of the user using the conventional hair iron 10 shown in FIG. 1 is more acute than the bending angle θn of the wrist of the user using the hair iron 300 according to the present invention shown in FIG. 9.

The hair iron according to the present invention includes the hinge section 180 and the handle 110 identical to those of the conventional hair iron 10, and the heating plate 120 is attached to the supporter such that the surface of the heating plate 120 is inclined relative to the horizontal plane of the handle by the inclination angle θi. Thus, the user who uses the hair iron 100, 200 or 300 according to the present invention can perform curly hairdressing without excessively bending the wrist of the user.

The inclination angle θi is preferably in the range of 15° to 45°. If the inclination angle θi is less than 15°, the wrist may not be effectively protected. In addition, if the inclination angle θi exceeds 45°, the wrist may be bent in the opposite direction as compared with the case of using the conventional hair iron 10, thereby causing damage to the muscle and/or bone of the user.

Each of the three embodiments of the present invention may additionally include heat shielding means positioned within the handle 110 or elsewhere within the upper body 101 and/or lower body 102. For instance, a plate (not shown) may be inserted within the handle 110 portion of the upper body 101 and lower body 102 for shielding the user's hand from heat generated by the hair iron 100. The plate may be constructed of any material suitable for preventing or reducing conduction of heat through the hair iron 100.

Also, each of the three embodiments of the present invention may further include a heat sensor (not shown) positioned within the hair iron 100 for sensing the temperature of the hair iron 100. The heat sensor can optionally be disposed in communication with a set of electronics configured to reduce power supplied to the heating plates 120 of the hair iron. Alternatively, the electronics may be configured to shut off the hair iron 100 upon sensing of a certain predetermined temperature.

The advantageous features of the present invention are as follows.

First, the surface of the heating plate is inclined relative to the horizontal plane of the handle by the predetermined angle. According to the first and second embodiments of the present invention, the supporter 130, to which the heating plate is attached, is inclined relative to the horizontal plane of the handle by the predetermined angle. In addition, according to the third embodiment of the present invention, the horizontal plane of the supporter 130 is parallel to the horizontal plane of the handle 110, and the heating plate is attached to the supporter such that the surface of the heating plate is inclined relative to the horizontal plane of the handle by the predetermined angle. Thus, the heating plate 120 is inclined by the predetermined inclination angle.

Second, at least one edge of the heating plate is rounded, so that hair can be prevented from being damaged by the edge of the heating plate during curly hairdressing.

Third, the far-infrared ray device is installed on the surface of the heating plate to emit far-infrared rays. In particular, the insulating member is interposed between the hole of the heating plate and the far-infrared ray device in order to insulate the far-infrared ray device from heat. If the far-infrared ray device has superior endurance against heat generated from the heating plate, the insulating member may be omitted.

Although exemplary embodiments of the present invention have been described, it is understood that the present invention should not be limited to these exemplary embodiments, but various changes and modifications can be made by one ordinary skilled in the art within the spirit and scope of the present invention as hereinafter claimed.

What is claimed is:

1. A hair iron comprising:

an upper body; and a lower body coupled to the upper body by a hinge section defining an axis of rotation, wherein each of the upper and lower bodies comprises:

a handle formed at one end thereof with the hinge section and lying in a plane;

a supporter extending from the handle along a longitudinal axis that extends from the hinge section; and a heating plate attached to the supporter, wherein the supporter and heating plate are both inclined in the same direction about the longitudinal axis with respect to the plane.

2. The hair iron as claimed in claim 1, further comprising a far-infrared ray device positioned within at least one of the upper and lower bodies, the far-infrared ray device exposed to an exterior of the hair iron through a hole formed in one of the heating plates.

3. The hair iron as claimed in claim 2, wherein an insulating member is interposed between the far-infrared ray device and the hole to insulate the far-infrared ray device from heat generated by the heating plate.

4. The hair iron as claimed in claim 1, wherein at least one edge of the heating plate making contact with hair is rounded.

5. A hair iron comprising:

an upper body; and a lower body coupled to the upper body by a hinge section, wherein each of the upper and lower bodies comprises:

a handle formed at one end thereof with the hinge section;

a supporter extending from the handle; and a heating plate attached to the supporter and provided with at least one far-infrared ray device that emits infrared rays, the plate including a plurality of apertures extending through the plate and positioned to emit infrared rays through the apertures.

6. The hair iron as claimed in claim 5, wherein the far-infrared ray device is exposed to an exterior of the hair iron through a hole formed in the heating plate.

7. The hair iron as claimed in claim 6, wherein an insulating member is interposed between the far-infrared ray device and the hole to insulate the far-infrared ray device from heat generated from the heating plate.

8. The hair iron as claimed in claim 5, wherein at least one edge of the heating plate making contact with hair is rounded.

9. The hair iron as claimed in claim 5, wherein a plane of the supporter is inclined relative to a horizontal plane of the handle by a predetermined angle.

10. The hair iron as claimed in claim 5, wherein a plane of the supporter is parallel to a horizontal plane of the handle, and the heating plate is attached to the supporter such that a plane of the heating plate is inclined relative to the horizontal plane of the handle by a predetermined angle.

* * * * *